United States Patent [19]

Kesten

[11] Patent Number: 4,476,918

[45] Date of Patent: Oct. 16, 1984

[54] METHOD AND APPARATUS FOR A TEMPERATURE-SHIFTED CHEMICAL HEAT PIPE

[75] Inventor: Arthur S. Kesten, West Hartford, Conn.

[73] Assignee: United Technologies Corporation, Hartford, Conn.

[21] Appl. No.: 392,441

[22] Filed: Jun. 28, 1982

[51] Int. Cl.[3] ..... F28D 15/00

[52] U.S. Cl. ..... 165/1; 165/104.12; 165/DIG. 17; 165/104.21; 422/149; 422/189; 422/190; 422/194; 422/196; 585/402; 585/910

[58] Field of Search ..... 165/104.12, DIG. 17, 165/104.21; 422/149, 189, 190, 194, 198, 207, 312; 436/34; 585/402, 910

[56] References Cited

U.S. PATENT DOCUMENTS 4,044,821 8/1977 Fletcher et al. ..... 165/104.12 X 4,161,210 7/1979 Reid et al. ..... 165/104.12 X

*Primary Examiner*—Barry S. Richman

*Assistant Examiner*—William R. Johnson

*Attorney, Agent, or Firm*—Stephen A. Schneeberger

[57] ABSTRACT

A method and apparatus are provided in a chemical heat pipe for shifting the reaction equilibrium in order to operate at a "shifted" temperature without also "shifting" the pressure. A diluent is added to the heat pipe in a constant-pressure manner near a reaction zone. The diluent exists in the gaseous phase at the reaction zone so as to shift the reaction equilibrium. This has the effect of "shifting" the temperature required for the reaction to proceed to a predetermined extent. The diluent is chemically inert in the particular reacting system and is removed from the system so as not to increase the pressure therein. In a preferred embodiment, methylcyclohexane is dissociated by endothermic reaction at a heat source position to form toluene and hydrogen and water is added to the heat pipe at or near the heat source position to form a diluent of water vapor at the reaction zone. The diluent is removed from the system downstream of the reaction zone, as by a desiccant.

22 Claims, 3 Drawing Figures

METHOD AND APPARATUS FOR A TEMPERATURE-SHIFTED CHEMICAL HEAT PIPE

DESCRIPTION

1. Technical Field

The present invention relates to the method of apparatus for transporting thermal energy and more particularly through the agency of a chemical heat pipe.

2. Background Art

Various techniques have been employed for transferring or transporting thermal energy between a thermal source and a thermal sink or load. Heat pipes have found utility for this purpose, especially where it is desired to transfer the heat as efficiently as possible. A heat pipe is generally considered a closed-loop, two-cycle system. In a vaporization/condensation type of heat pipe, rapid heat transfer into the pipe results in evaporation of a working fluid therein. Evaporated working fluid builds up sufficient pressure to be transmitted along the pipe and is then condensed at the other end thereof. The cycle is completed by returning the condensate to capillary or other action through a wick or suitable means within the pipe. However, because the working fluid is at an elevated temperature vaporized state while transporting the thermal energy from the heat source to the heat sink, it may experience significant radiation, convection and conduction losses to the environment which is normally at a significant lower temperature.

In situations in which it is desired to transport heat over relatively long distances exceeding tens of feet and sometimes miles, and wherein the thermal loss normally attending a vaporization/condensation type of heat pipe would be intolerable, chemical heat pipes may provide a preferable alternative. In a chemical heat pipe, a reactant, or reactants, undergoes an endothermic reaction at the heat source to produce reaction product which is transported to the heat sink whereupon it undergoes an exothermic reaction to liberate heat which has been stored and transported in a chemical form. The exothermic reaction typically serves to reform the reactant which is then returned to the heat source for recycling. Such chemical heat pipes permit the transmission of thermal energy via low temperature fluids which are reacted at substantially higher temperatures at the heat source and heat sink. The fluids may be transported through the heat pipe by blowers and pumps or, as in U.S. application Ser. No. 226,320 now U.S. Pat. No. 4,346,752, issued Aug. 31,1982, entitled "Self-Driven Chemical Heat Pipe" filed on Jan. 19 1981 by A. S. Keston and A. F. Haught, and owned in common herewith, the heat pipe may be structured and operated such that it is self-driven.

The utility of such chemical heat pipes has generally been limited to situations in which the source temperature is much higher than the sink temperature in order to capitalize on the change of equilibrium position with temperature. However, in those situations the long-term stability of the reactant is often sacrificed because of the relatively high source temperatures. For instance, at the higher source temperatures, there may be small side reactions which occur, or which occur to a greater extent than at lower temperatures, and which may impair the satisfactory operation of the catalyst typically found in such chemical heat pipes.

Moreover, a variety of sources of relatively low grade industrial waste heat exist from which it is desirable to transport thermal energy over long distances using chemical heat pipes.

The prior art contains examples of chemical heat pipes in which a decomposition reaction occurs at the heat source at a temperature lower than the recombination reaction which occurs at the heat sink. Examples of such systems are to be found in U.S. Pat. No. 4,044,821 for "Low to High Temperature Energy Conversion System" by J. C. Fletcher and C. G. Miller and in U.S. Pat. No. 4,161,210 for "Temperature Increase System" by A. F. Reid and A. H. Halff. In each of those systems some provision is made for separating some one of the reactants or reaction products from one another to shift the reaction equilibrium in a desired direction, and in the Fletcher patent, the primary reason for the equilibrium shift is the change in pressure. The separation may occur in a variety of manners including absorption/desorption, membrane separation and the like. With such systems however, the means for separating the constituents must selectively respond to one of the reactants or reaction products. This requirement may place significant limitations on the system, depending upon the particular reactions and reactants involved.

A principal object of the present invention is the provision of a chemical heat pipe and the operation thereof such that the reaction equilibrium at a reaction region may be shifted in a desired direction to accommodate a desired temperature without resorting to selective separation of the reactant or reaction product constituents.

In accordance with the present invention, there is provided a method and apparatus for shifting the reaction equilibrium of a chemical heat pipe in order to operate at a "shifted" temperature. More specifically, in a chemical heat pipe employing reversible endothermic/exothermic chemical reactions to transfer heat between the heat source at one temperature and a heat sink at a lower temperature, there is provided a method and apparatus for shifting the equilibrium at either the heat source or the heat sink position to allow reaction to occur thereat at a different temperature while maintaining substantially the same pressure levels within the heat pipe. A diluent is introduced to the heat pipe circuit at or upstream of, the predetermined one of the heat source or the heat sink positions. The diluent exists in the gaseous state at that preselected one of the heat source or heat sink positions during the respective dissociation or recombination reaction occurring thereat. A substantial portion of the diluent is then removed from the reactant or reaction product downstream of the preselected one of the heat source or heat sink positions. The diluent addition and removal is such as to maintain the pressure substantially constant at the preselected one of the heat source or heat sink positions, whereby the excess moles introduced by the diluent shifts the equilibrium in the desired direction at that predetermined location to change the extent of reaction at a given temperature or to allow the reaction to occur at a different temperature than otherwise. The diluent is substantially chemically inert in the heat pipe reactants and reaction products to which it is exposed.

In a preferred embodiment, the diluent is introduced to the heat pipe upstream of the heat source position and is removed from the reaction product downstream of the heat source position such that the endothermic reaction at the heat source position occurs at a lower source temperature than would be the case if said diluent were absent. The heat pipe reactions typically include a dehydrogenation reaction and a hydrogenation reaction. A heat pipe employing methylcyclohexane as the reactant and toluene and hydrogen as the reaction product is particularly suited to the invention. In such system the diluent may conveniently be water.

The removal of the diluent from the heat pipe may be accomplished using any of several suitable mechanisms, the use of a desiccant being particularly suited for the removal of water. The diluent removed from the heat pipe may be recycled to provide the supply or make-up for introduction to the heat pipe.

BEST MODE FOR CARRYING OUT THE INVENTION

Figure 1:
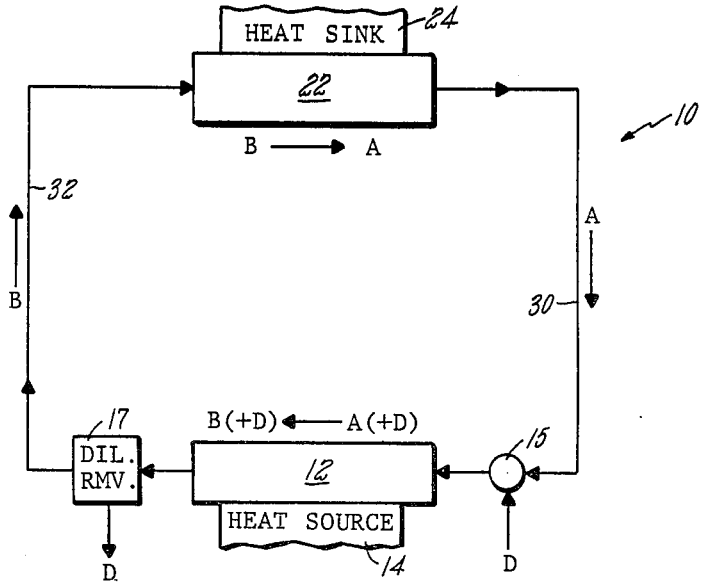
FIG. 1 is a generalized schematical diagram of the temperature-shifted chemical heat pipe of the invention.

Referring to the drawings, there is illustrated in FIG. 1 a "temperature-shifted" chemical heat pipe 10 in accordance with the present invention. The heat pipe 10 includes a flow path extending between a reaction chamber 12, adjacent a heat source 14, and a reaction chamber 22 adjacent a heat sink 24. In the preferred situation, the reaction chambers 12 and 22 and the conduit connecting them are joined to form a closed loop or circuit. The reaction chamber 12 is heated to a temperature determined by that of heat source 14, and defines a heat source position. Similarly, the reaction chamber 22 defines a heat sink position for delivering thermal energy to the heat sink 24 at a temperature determined by the reaction occurring in chamber 22. Reactant A is conducted through conduit arm 30 to the heat source position 12 at which it endothermically reacts to remove heat from heat source 14. Reactant A may be one or more constituents. The endothermic reaction in chamber 12 creates reaction product B, which may be one or more constituents, which reaction product is conducted via conduit arm 32 to the heat sink position 22. In reaction chamber 22 the reaction product B undergoes exothermic reaction to release heat to heat sink 24 and is recombined to form reactant A.

The parameters determining operation of the heat pipe 10 include the particular constituents of reactant A and reaction product B, as well as the system pressure and the temperature at the heat source 14 and the heat sink 24. The rate of circulation within the conduit may also be a factor. Certain reactants A may be preferred for particular heat pipe applications; however, the efficient utilization of such reactant is often strongly dependent upon the temperatures at the heat source 14 and/or the heat sink 24 and the differential therebetween. Many chemical reactions suitable for heat pipe applications require a heat source temperature in excess of 300° C. On the other hand, the quality or temperature of heat available at the heat source may be less than is optimum for the desired reaction and accordingly, the efficiency of the system suffers.

In accordance with the present invention, provision is made for shifting the reaction equilibrium at one of the reaction chambers 12 or 22 to allow the reaction thereat to occur at a different heat source or heat sink temperature respectively, while maintaining substantially the same pressure levels within the heat pipe system. Such shift in the reaction equilibrium at a reaction location is accomplished by the constant pressure addition of a diluent D to the system such that it exists as a gas at the reaction zone. The diluent is inert as regards the reaction occurring at that zone and accordingly does not chemically enter into the reaction but does contribute a particular number of moles of inert gas to the gas present hereat and accordingly serves to shift the equilibrium position for the reaction occurring. The constant-pressure addition of the diluent D is accomplished by adding the diluent at or upstream of the reaction zone, as for instance at mixing junction 15 immediately upstream of reaction zone 12, and then subsequently removing the diluent from the system immediately downstream of that reaction zone, as by a removal mechanism 17. The removal mechanism 17 selectively removes the diluent D from the reaction product B.

For an understanding of how the constant-pressure addition of the diluent shifts the reaction equilibrium, consideration should be given to the following analysis. In a chemically reacting system where $$\nu_{A1}A_1+\nu_{A2}A_2+\ldots \rightleftharpoons \nu_{B1}B_1+\nu_{B2}B_2+\ldots$$

where $\nu_{A1}$, $\nu_{A2}$ etc represent the number of moles of reactants, $A_1$, $A_2$, etc. and $\nu_{B1}$, $\nu_{B2}$, etc. represent the number of moles of reaction products $B_1$, $B_2$ etc., the equilibrium constant is given by $$K_P=\frac{(n_{B1})^{\nu_{B1}}(n_{B2})^{\nu_{B2}}\cdots}{(n_{A1})^{\nu_{A1}}(n_{A2})^{\nu_{A2}}\cdots}\left(\frac{P}{\Sigma n}\right)^{\Delta\nu}$$

where $n_{A1}$, $n_{A2}$, $n_{B1}$ etc. are the number of moles of $A_1$, $A_2$, $B_1$, etc. in the system and $$\Delta\nu=\nu_{B1}+\nu_{B2}+\ldots-\nu_{A1}-\nu_{A2}-\ldots.$$

The constant pressure (P) addition of an inert gas increases the number of moles, $\Sigma$ n, in the system. If there were no mole change on reaction, $\Delta\nu$ would be 0 and the position of the equilibrium would not be changed. If the forward reaction resulted in an increase in the number of moles, $\Delta\nu$ would be positive and, in order to maintain equilibrium, the composition would change. If the pressure were kept constant, the number of moles in the right hand side of the chemical equation would increase and the number of moles on the left would decrease in order to maintain the constant value of $K_P$. That is, reaction would be driven in the forward direction by the addition of the inert gas. Conversely, if $\Delta\nu$ were negative, the addition of the inert gas would shift the position of equilibrium from right to left provided the pressure were maintained constant.

In the chemical heat pipe 10 in which the endothermic reaction occurring at heat source position 12 increases the number of moles in the system, the addition of an inert gas, i.e. diluent D, will promote the dissociation process. Thus the dissociation process, which may be a dehydrogenation reaction, may be supported at a lower temperature than without the diluent. If the inert gas diluent is removed downstream of heat source position 12 by diluent removal means 17, recombination at the heat sink position 22 is unaffected.

Figure 2:
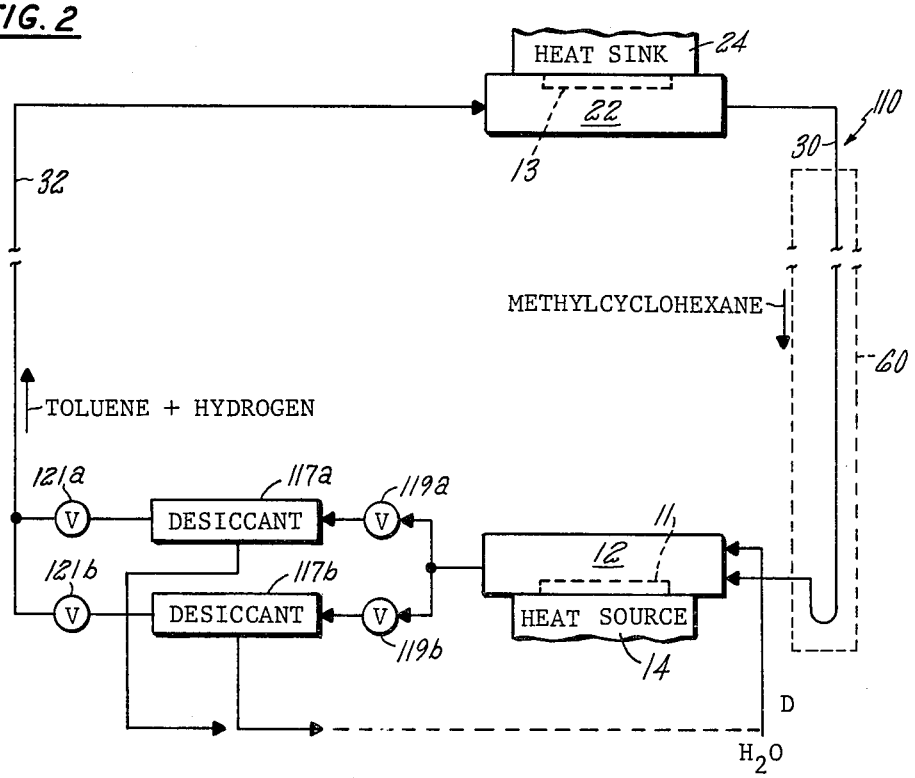
FIG. 2 is a schematical diagram of a specific chemical heat pipe in accordance with the invention.

Referring now to FIG. 2, further consideration will be given to a preferred embodiment of a heat pipe 110 in which methylcyclohexane ($C_7H_{14}$) is endothermically dehydrogenated or dissociated at heat source position 12 to form reaction product which includes toluene ($C_7H_8$) and hydrogen ($3H_2$). The toluene and hydrogen flow through conduit arm 32 to the heat sink position 22 at which they are exothermically recombined to release heat to the sink 24 and reform methylcyclohexane. The endothermic reaction at source position 12 and the exothermic reaction at sink position 22 may each be enhanced by the presence of respective catalysts 11 and 13. Catalysts 11 and 13 may be platinum and nickel, ruthenium, palladium or platinum, respectively. The $C_7H_{14} \rightleftarrows C_7H_8 + 3H_2$ reaction is reversible and is particularly suitable for utilization in chemical heat pipes for the transmission of thermal energy over long distances because of its moderate temperature operating range and potential for long term stability. The heat pipe 110 may include conventional pumping means or, as described in the aforementioned U.S. patent application Ser. No. 226,320 incorporated herein by reference, it may be self-driven. For such self-driven operation, it is desirable to insure that the recombined methylcyclohexane exiting the sink position 22 is condensed to the liquid state such that it occludes a portion of the return arm 30 and forms a liquid seal, represented by dotted line 60, to maintain unidirectional flow about the heat pipe.

It will be understood from the foregoing discussion that the addition of a gaseous diluent can, under conditions of constant pressure, shift the position of equilibrium of a particular reaction in one direction or the other, depending upon the particular reaction. Thus the addition of a diluent may be used to accommodate an endothermic reaction at a relatively lower temperature at a heat source position or accommodate an exothermic reaction at a relatively lower temperature at a heat sink position.

In the embodiment of FIG. 2, it is desired that the endothermic dissociation reaction occurring at heat source 12 proceed to a predetermined extent, yet at a relatively lower temperature than would otherwise be the case if the diluent were not present. In that respect, it is desired to shift the reaction $$C_7H_{14} \rightleftarrows C_7H_8 + 3H_2$$

in the forward direction, i.e. to the right. The foregoing analysis of the effects of diluent addition on shifting the equilibrium of a reaction will again be considered, now with regards to the specific endothermic reaction by which methylcyclohexane (M) is dissociated into reaction product comprising toluene (T) and hydrogen ($H_2$). The equilibrium constant for the hydrogenation/dehydrogenation reaction pair is traditionally expressed with the hydrogenation reaction as the forward direction. Under that condition, the equilibrium constant, without the presence of a diluent, is given by $$K_P = \frac{\zeta(1 + \beta - 3\zeta)^3}{(\beta - 3\zeta)^3 (1 - \zeta)} (P)^{-3}$$

where $\zeta$ represents the extent of the hydrogenation reaction which equals $$1 - \frac{N_T}{N_{Mo}}$$

where $N_T$ = the number of moles of toluene and $N_{MO}$ = the initial number of moles of methylcyclohexane prior to dissociation and wherein $\beta$ represents the molar ratio of hydrogen to toluene and $\beta = 3$ for the present reaction. The value P represents pressure. It will be understood that $1 - \zeta$ represents the extent of the dehydrogenation reaction.

With the addition of a diluent, the equilibrium constant appears as follows:

$$K_P{}' D = \frac{\zeta(1 + \beta + 3\zeta + \alpha)^3}{(\beta - 3\zeta)^3 (1 - \zeta)} (P)^{-3}$$

wherein a dilution parameter $\alpha$ has been introduced. The dilution parameter $$\alpha = \frac{N_D}{N_{Mo}}$$

where $N_D$ is the number of moles of inert diluent.

Figure 3:
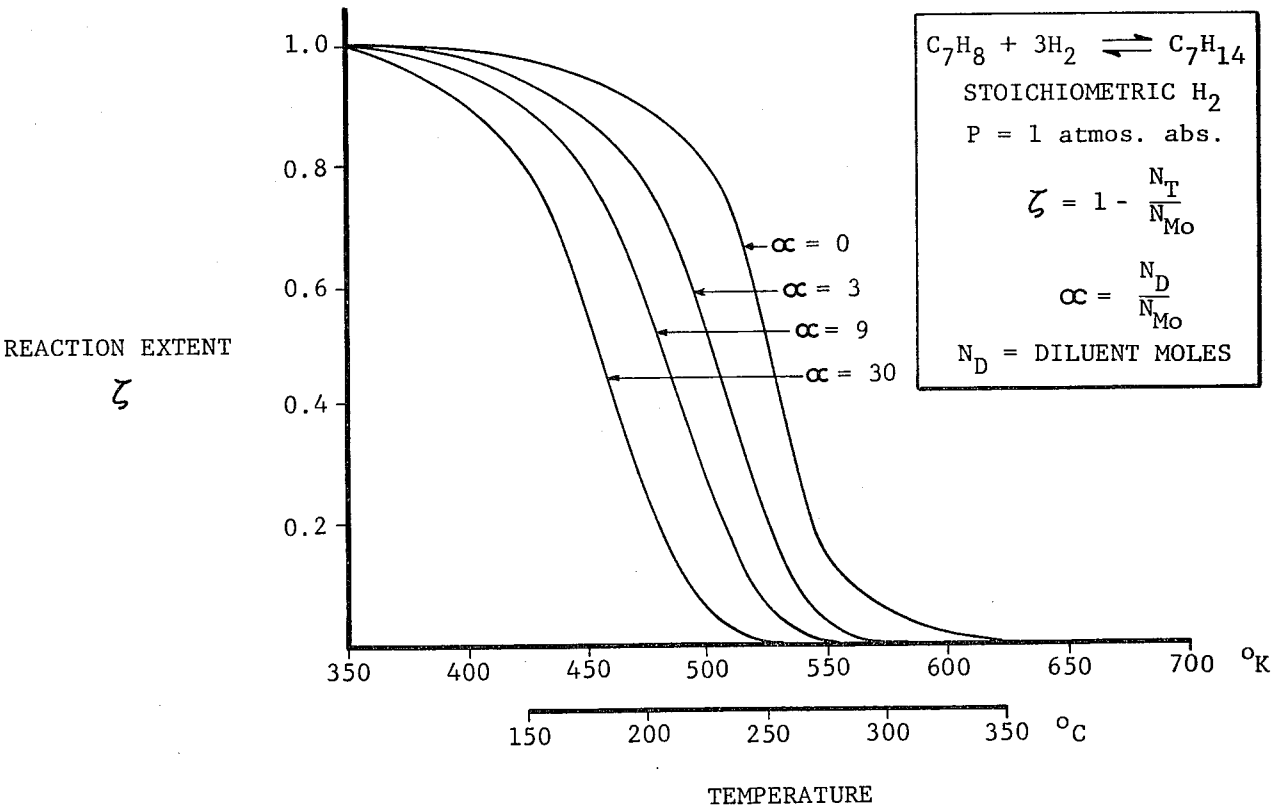
FIG. 3 is a graph illustrating the effect of different levels of diluent on equilibrium for the heat pipe of FIG. 2.

Referring to FIG. 3, the shift in equilibrium is shown for P = 1 atmosphere, $\beta = 3$ and wherein the dilution parameter $\alpha = 0, 3, 9$, and 30. Note that $\beta = 3$ is stoichiometric $H_2$, which makes the calculations relevant to dehydrogenation with no initial $H_2$, which is the expected case. Then $\alpha = 3$ represents equal diluent and final hydrogen, and $\alpha = 9, 30$ are diluents 3, 10 times $H_2$ respectively. The results in FIG. 3 show inert dilution shifts the dehydrogenation point ($\zeta \rightleftarrows 0$) to lower temperatures, about 75° C. lower for $\alpha = 30$. As an example for $\alpha = 30$ and $\zeta = 0.05$, the temperature requirement is lowered to 225° C. from 300° C., a significant change. Stated another way, this means that for the dehydrogenation of methylcyclohexane to be 95% complete without the diluent, the source temperature must be approximately 300° C. or 573° K.; whereas that reaction may proceed to the same degree for a source temperature of 225° C. or 498° K. if sufficient diluent is present at the source position 12 for the dilution parameter $\alpha$ to have a value of 30. A desired value of the dilution parameter = may be maintained and/or monitored by measuring the relative flow rates of the methylcyclohexane and the diluent, as by sensing respective pressure differentials.

Returning to FIG. 2, the diluent D introduced to the heat pipe 110 for shifting the dehydrogenation reaction of methylcyclohexane to a lower temperature is water ($H_2O$). The water is inert relative to the methylcyclohexane, toluene and hydrogen as they exist in the region of the heat source position 12. The water is introduced to the heat source reaction chamber 12 at its upstream side and preferably in its vapor state. It will be understood, however, that the water might be introduced in a liquid state and vaporized therein by the present source of heat such that it exists in the vapor or gas state during dehydrogenation reaction of the methylcyclohexane.

Following the dehydrogenation reaction of methylcyclohexane in reaction chamber 12, it is necessary to remove the water diluent from the heat pipe 110 in order not to increase the pressure in the system. The water may be removed from the heat pipe by any of several convenient means, the use of desiccants $117_A$, $117_B$ being preferred in the present embodiment. Desiccants $117_A$, $117_B$ are connected in respective parallel paths in relatively close proximity to the downstream side of heat source chamber 12. By providing a pair of parallel desiccant paths, each desiccant $117_A$ and $117_B$ may be sized such that it alone is capable of extracting substantially all of the water diluent from the system. A pair of valves $119_A$, $121_A$ at opposite ends of desiccant $117_A$ and value pair $119_B$, $121_B$ at opposite ends of desiccant $117_B$ enable the desiccants $117_A$ and $117_B$ to be used in alternation such that while one is absorbing water from the heat pipe the other may be valved out of the system and regenerated, using known techniques, for subsequent alternation with the other desiccant chamber. During regeneration the absorbed water is released from the desiccant and becomes available for recycling to the upstream side of the reaction chamber 12. Such a system and mode of operation permits continuous utilization of the heat pipe 110. Almost any material which forms a hydrate at the source temperature could be used as the desiccant. Regeneration of the absorber is easily accomplished by heating.

Candidate materials for the inert diluent gas are those which can be injected easily, removed easily and will cause little or no difficulty if the material is not completely absorbed at the desired location. It is important that small remaining amounts of the inert diluent not act as a poison to the catalyst nor otherwise adversely affect the efficiency or possible self-pumping action of the heat pipe. Using such criteria, it will be appreciated that a variety of agents including hydrogen might be suitable for use as the inert diluent gas, depending upon the chemical system within the heat pipe. In the event hydrogen were the diluent, it might be removed by using a semipermeable membrane. Moreover, it will be understood that other reactants and reaction products might also be used. For instance, the dissociation/recombination reaction involving cyclohexane and benzene and hydrogen is only slightly different than that illustrated in accordance with FIG. 2 and may provide a suitable alternative.

Although this invention has been shown and described with respect to detailed embodiments thereof, it will be understood by those skilled in the art that various changes in form and detail thereof may be made without departing from the spirit and scope of the claimed invention.

We claim:

1. In a chemical heat pipe employing reversible endothermic/exothermic chemical reactions to transfer heat between a heat source at one temperature and a heat sink at a lower temperature and including a conduit in heat transfer relation with a heat source and a heat sink at respective heat source and heat sink positions along the conduit and a chemical reactant being endothermically reacted in said conduit at said heat source position to create a gaseous reaction product, said heat source reaction product being caused to flow through said conduit to said heat sink position where it is exothermically reacted to release heat, said endothermically and exothermically reacting system having particular reaction equilibria at temperature and pressure levels associated with the respective said heat source and heat sink positions, the method of shifting the equilibrium at one of said positions to allow reaction to occur at a different heat source or heat sink temperature while maintaining substantially the same said pressure levels, comprising the steps of:

introducing a diluent to the conduit such that it exists in the gaseous state at a predetermined one of the heat source and heat sink positions during the respective reaction occurring thereat; and removing a substantial portion of the diluent from the reactant or reaction product downstream of said predetermined one of the heat source and heat sink positions, said diluent addition and removal being such as to maintain the pressure at said predetermined one of the heat source and heat sink positions substantially constant, whereby the excess moles introduced by the diluent shifts the equilibrium in a predetermined direction at said predetermined one of said heat source and and heat sink positions in order to allow reaction to occur at a respective different heat source or heat sink temperature.

2. The method of claim 1 wherein said diluent is introduced to the conduit at or upstream of said heat source position and is removed from said reaction product downstream of said heat source position, and wherein said endothermic reaction occurs at a lower heat source temperature than without said diluent being present.

3. The method of claim 2 wherein said diluent is substantially chemically inert in the system.

4. The method of claim 2 wherein said endothermic reaction results in dissociation of said reactant to form said reaction product and said exothermic reaction results in recombination of said reaction product to form said reactant, said conduit being a closed circuit.

5. The method of claim 2 wherein said step of removing said diluent from said reaction product further includes removing said diluent from said conduit.

6. The method of claim 5 wherein said step of intoducing said diluent includes recycling at least a substantial portion of the diluent obtained by said step of removing said diluent from the reaction product and conduit.

7. The method of claim 2 wherein said endothermic reaction is a dehydrogenation reaction and said exothermic reaction is a hydrogenation reaction.

8. The method of claim 7 wherein said hydrogenation and dehydrogenation reactions are each conducted in the presence of a respective catalyst.

9. The method of claim 7 wherein said diluent is water.

10. The method of claim 9 wherein said step of removing said diluent includes contacting said reaction product and water vapor with a desiccant, said desiccant removing said water vapor from said reaction product by drying action.

11. The method of claim 7 wherein said reactant is a hydrocarbon.

12. The method of claim 11 wherein said reactant is a hydrocarbon.

13. The method of claim 12 wherein said diluent is water.

14. In a chemical heat pipe employing reversible endothermic/exothermic chemical reactions to transfer heat between a heat source at one temperature and a heat sink at a lower temperature, said heat pipe including a conduit in heat transfer relation with a heat source and a heat sink at respective heat source and heat sink positions along the conduit, a chemical reactant being endothermically reacted in said conduit at said heat source position to create a gaseous reaction product, said reaction product being caused to flow through said conduit to said heat sink position and being exothermically reacted thereat to release heat, said endothermically and exothermically reacting system having particular reaction equilibria at temperature and pessure levels associated with the respective said heat source an heat sink positions, the improvement comprising:

means for shifting the equilibrium at one of said positions to allow reaction to occur at a different heat source or heat sink temperature while maintaining substantially the same pressure levels, said equilibrium shifting means including means for introducing a diluent to the conduit such that said diluent exists in the gaseous state at a predetermined one of the heat source and heat sink positions during the respective reaction occurring thereat, whereby the excess moles introduced by the diluent shifts the reaction equilibrium in a predetermined direction at said predetermined one of the heat source and heat sink positions.

15. The heat pipe of claim 14 wherein said equilibrium shifting means includes means for removing a substantial portion of the diluent from the reactant or reaction product downstream of said predetermined one of the heat source and heat sink positions, said diluent introducing and removing means being such as to maintain the pressure at the predetermined one of the heat source and heat sink positions constant.

16. The heat pipe of claim 2 wherein said diluent is introduced to the conduit at or upstream of said heat source position and is removed from said reaction product downstream of said heat source position, and wherein said endothermic reaction occurs at a lower heat source temperature than without said diluent being present.

17. The heat pipe of claim 16 wherein said diluent removing means is operative to remove said diluent from said conduit, said diluent so removed being available for recycling to said diluent introducing means.

18. The heat pipe of claim 16 wherein said conduit downstream of said heat source position includes parallel branches, each said parallel branch being valved and including respective said diluent removing means, whereby the diluent removing means in one said branch may be effectively dissconnected fom the conduit while the diluent removing means in another said branch remains operative in the conduit.

19. The heat pipe of claim 16 wherein said diluent is substantially chemically inert in the system.

20. The heat pipe of claim 19 wherein said reactant is methylcyclohexane, said reaction product is toluene and hydrogen, respective catalyst being located at each of said heat souce and heat sink reaction positions, and wherein said conduit is a closed circuit.

21. The heat pipe of claim 19 wherein said reactant is a hydrocarbon, said endothermic reaction is a dehydrogenation reaction, said exothermic reaction is a hydrogenation reaction and said diluent is water.

22. The heat pipe of claim 21 wherein said diluent removing means includes a desiccant for removing said water vapor from said reaction product by drying action.

* * * * *